United States Patent [19]

Ravicchio et al.

[11] 3,934,752

[45] Jan. 27, 1976

[54] END WALL CLOSURE APPARATUS

[75] Inventors: Donald P. Ravicchio, Appolo; Carl H. Geary, Greensburg, both of Pa.

[73] Assignee: Carrier Corporation, Syracuse, N.Y.

[22] Filed: Jan. 17, 1974

[21] Appl. No.: 434,167

[52] U.S. Cl. ..... 220/328; 220/3; 277/236; 292/256.6

[51] Int. Cl.[2] ..... B65D 45/00

[58] Field of Search ..... 220/3, 55 Y, 55 J, 55 Z, 220/55 AN, 46 R, 3, 328; 292/256.6; 277/188, 189, 236, 70

[56] References Cited

UNITED STATES PATENTS

| | | | |
|---|---|---|---|
| 2,939,753 | 6/1960 | Schilling et al. | 220/46 R |
| 3,109,661 | 11/1963 | Swaim et al. | 277/70 |
| 3,552,789 | 1/1971 | Evans | 292/256.6 |

*Primary Examiner*—William I. Price
*Assistant Examiner*—Allan N. Shoap
*Attorney, Agent, or Firm*—J. Raymond Curtin; Thomas J. Wall

[57] ABSTRACT

An end wall closure device for supporting the end wall of a pressure vessel against axial movement when subjected to load conditions. A retaining member made up of a segmented shear key and a segmented compression key is inserted within an internal groove provided within the vessel casing. The shear key is seated in a recessed shoulder formed in the end wall and is provided with a pair of raised moment control pads which, in assembly, act upon the compression key and the casing wall. The pads are strategically positioned to negate the bending moments acting on the retaining member thus minimizing the deflection of the retaining member when placed under load.

4 Claims, 3 Drawing Figures

END WALL CLOSURE APPARATUS

BACKGROUND OF THE INVENTION

In many pressure vessel applications, particularly those involving rotating machinery, it is extremely important to maintain the position of the end wall closure relatively constant under varying load conditions. In a case of a turbo machine, such as turbines and compressors, the end wall generally serves to support the stationary machine components in relation to the shaft mounted moving components. As can be seen, any axial shifting of the end wall, beyond allowable limits, will have a deleterious effect upon the operation of the machine and, in extreme cases, may lead to complete machine failure.

Various retaining or closure devices have been devised to accomplish the above-noted results as exemplified by Fisher in U.S. Pat. No. 2,342,186 and Evans in U.S. Pat. No. 3,552,789. However, these prior art devices all suffer from the same disadvantages in that they are complex, difficult to assemble and, more importantly, they are all subject to undesirable bending stresses which cause the retaining mechanisms to deflect under load. This deflection allows the end wall to shift axially, thus producing a misalignment of the interrelated components.

SUMMARY OF THE INVENTION

It is therefore an object of the present invention to improve apparatus for supporting an end wall within a pressure vessel.

It is a further object of the present invention to provide an end wall closure device for use in a pressure vessel which retains the end wall against axial movement.

A still further object of the present invention is to reduce the effects of unwanted bending stresses exerted upon an end wall closure key.

Yet another object of the present invention is to provide a simple, easily assembled, end closure device for preventing axial shifting of an end wall supported within a pressure vessel.

These and other objects of the present invention are attained by means of an end wall retaining member including a compression key and a shear key insertable in face-to-face alignment within an internal groove formed within the casing of a pressure vessel, the shear key further being seated within a recessed shoulder formed in the end wall and being provided with a pair of raised moment control pads arranged to act upon the compression key and the casing of the vessel, the moment control pads being strategically located to substantially eliminate the effect of bending stresses acting on the retaining device.

BRIEF DESCRIPTION OF THE DRAWINGS

For a better understanding of the invention as well as other objects and further features thereof, reference is had to the following detailed description of the invention to be read in connection with the accompanying drawings, wherein.

DESCRIPTION OF THE PREFERRED EMBODIMENT

The end wall retaining member of the present invention will herein be described with reference to a turbo machine, generally referenced 10. However, it should be clear to one skilled in the art that the apparatus of the present invention has suitable application for retaining the end wall structure of any type of pressure vessel and is not necessarily limited to this specific turbo machine application.

Figure 1:
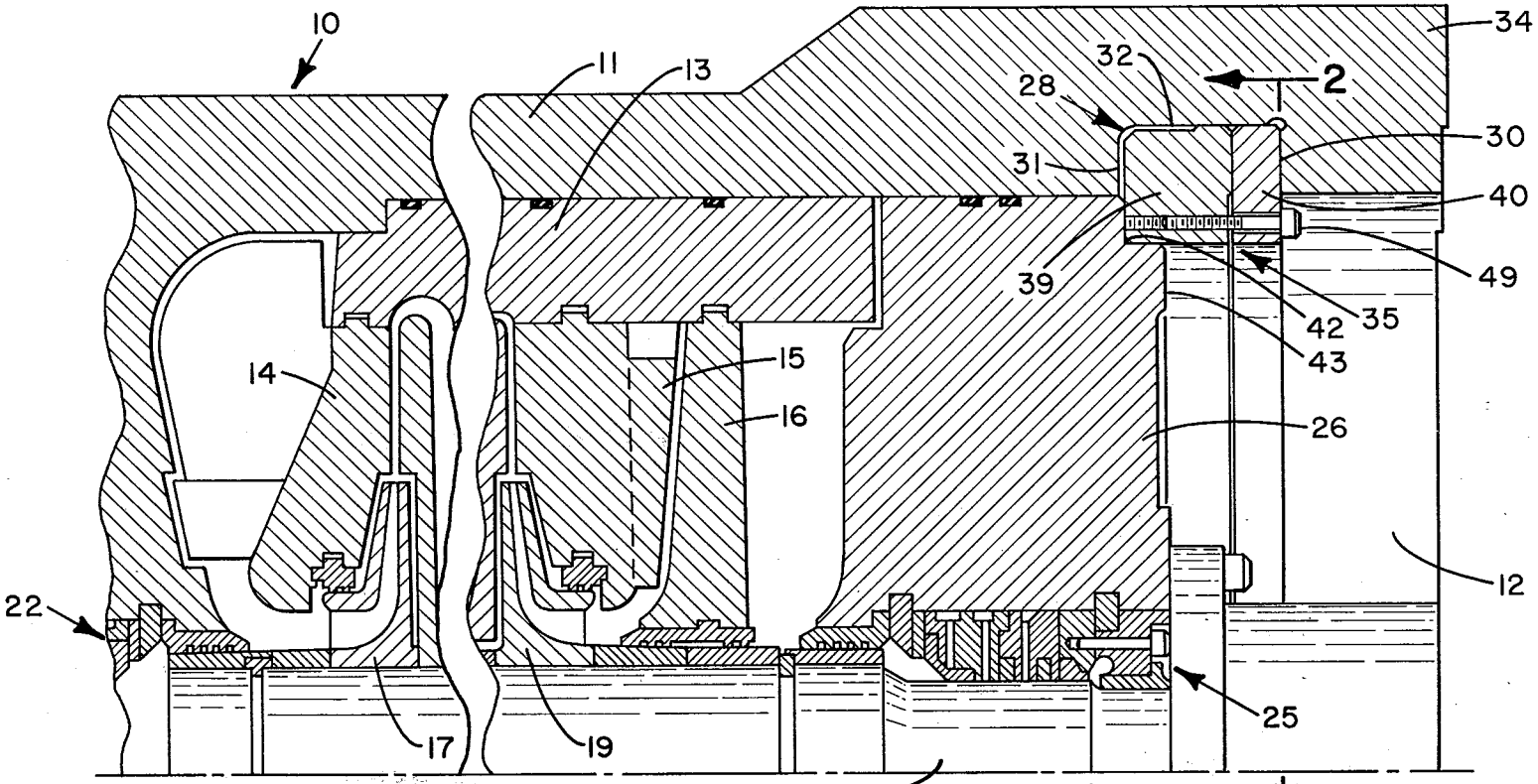
FIG. 1 is a partial sectional view of a turbo machine incorporating a retaining member embodying the teachings of the present invention.

The turbo machine illustrated in FIG. 1 is a "barrel" type compressor fabricated of a relatively heavy cylindrical outer casing 11 having an axially aligned cylindrical bored hole 12 provided therein. A second cylindrical casing 13 is mounted within the bore of the main outer casing and has secured thereto a number of diaphragms, some of which are indicated as 14, 15 and 16. The particular compressor illustrated is of the multistage, two section type having an impeller 17 located in the first stage of the first section and a second impeller 19 located in the first stage of the second section. As shown in FIG. 1, the two impellers are mounted so as to face in opposite directions whereby the stages in the first section and the stages in the second section are in back-to-back relationship. By opposing the stages of each section in this manner, the thrust forces exerted upon the rotor shaft 20 are minimized.

The last stage of the first section is arranged to discharge, via a diffuser passage and transfer crossover (not shown), into the inlet area of the second stage between diaphragms 14 and 15. The impellers of the machine are secured to the shaft 20 and the shaft is journaled for rotation within the machine. As viewed in FIG. 1, the left-hand end of the shaft is supported in a bearing structure 22, which is carried in the horizontal wall of the main machine casing, and at the opposite end in bearing structure 25, which is carried within independent end wall 26. For a more detailed description of the structural arrangement involving this type of turbo machinery, utilizing the transfer crossover, reference is had to U.S. Pat. No. 1,910,811.

As noted above, the apparatus of the present invention involves a retaining member for supporting the end wall structure within the casing of a pressure vessel and preventing the wall from shifting in an axial direction beyond allowable limits when placed under load.

Figure 3:
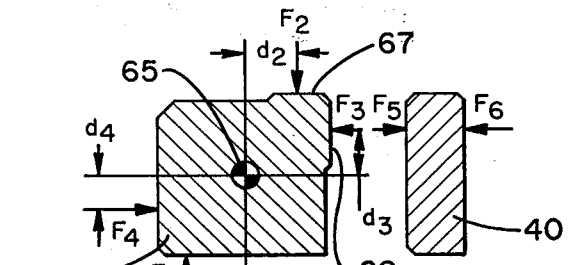
FIG. 3 is an enlarged exploded view showing the shear key and compression key which make up the retaining member embodying the teachings of the present invention and further illustrating the load forces acting thereon.

In this particular structure, the inner casing 13 terminates some distance inwardly from the open end of the outer casing 11. An internal annular groove 28, having a radially extending outer wall 30, a radially extending inner wall 31 and an axially extending bottom wall 32, is machined in the reinforced section 34 of the outer casing in proximity to the open end thereof. A retaining member, generally referenced 35, is mounted within the internal groove in the manner illustrated. The retaining member is made up of a pair of segmented keys including a shear key 39 and compression key 40. In assembly, the outer face of the compression key is mounted in contact with the radially extending outer wall 30 of the casing groove. The two assembled keys coact to make up an annular shaped retaining ring which complement the bottom wall 32 of the groove machined in the casing 11. As illustrated in FIGS. 1 and 3, both keys have a generally rectangular cross-sectional geometry; however, as will become apparent from the disclosure below, the size, shape and cross-sectional configuration of the keys are not limited to the particular structure herein disclosed and the retaining member geometry can be modified to accommodate any machine configuration without departing from the teachings of the present invention.

In practice, the radial thickness of the two keys exceeds the radial depth of the internal groove 28 such that a portion of each key extends downwardly beyond the internal casing wall into the axially extending opening 12. The lower left-hand corner of the shear key is seated within a complementary annular recessed shoulder 42 machined in the outer face 43 of the end wall structure. Although not shown, conventional means are provided to pull the end wall axially into assembly against the retaining member thus tensioning the retaining member in tight seating engagement against the outer radial wall of the casing and the recessed shoulder within the end wall.

Figure 2:
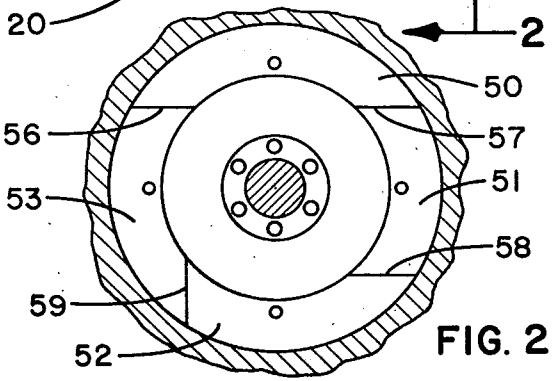
FIG. 2 is a reduced sectional view taken along line 2—2 in FIG. 1 illustrating the segmented sections of the retaining member.

Each key is made up of four distinct segments to facilitate their mounting within the casing groove. In the case of the compression key, as shown in FIG. 2, these segments include parts 50–53. The segments are arranged so that when seated in the groove, the segment ends are in abutting contact with each other thus forming three axially aligned joints 56, 57 and 58 and a radially aligned joint 59. The shear key segments are prevented from moving in a radial direction by the recessed shoulder provided in the end wall structure. As can be seen, however, further means must be provided for supporting the compression key segments against movement or misalignment. To this end, a series of cap screws 49 are passed through openings provided in the compression key segments and threaded into the corresponding shear key segments. When tightened, the cap screws pull the two keys into tight face-to-face alignment whereby a substantially unitized one-piece structure is superimposed between the end wall and the machine casing. The keys are machined to a predetermined size so that when the closure is locked in place, the end wall is accurately located in regard to the machine casing.

The depth of the recessed shoulder machined in the end wall provides sufficient contact area between the end wall structure and the retaining member whereby the contact stresses are maintained within allowable limits based upon the machine operating conditions. Because of the shear key seating arrangement, the end wall, when under load, exerts both an axial force $F_4$ and radial force $F_1$ (FIG. 3) against the end wall contact area of the shear key. These two determinable resultant forces are displaced some known distance from the center of gravity 65 of the shear key and act to create unwanted bending moments in the key. If the key is permitted to bend about its center of gravity, the key will deflect and thus drastically change its geometry. This, in turn, permits the end wall to shift axially from its predetermined position.

It is believed that this unwanted and uncontrolled deflection of the key is one of the primary factors contributing to the failure of most end wall retaining structures.

The shear key is provided with a pair of raised moment control pads 67, 68 (FIG. 3). As will be described in greater detail below, the pads are strategically positioned upon the shear key to produce opposite and substantially equal moments to the deflection inducing stresses described above. As a result, the bending moments acting on the key are negated and the key is primarily loaded in compression against the machine casing.

As more clearly illustrated in FIG. 1, a first raised moment control pad 67 is located upon the outer periphery of the shear key and is arranged to rest in contact against the machine casing within the bottom wall 32 of the groove 28. Similarly, the second raised moment control pad 68 is carried on the outer face of the shear key and is arranged to rest in contact against the inner face of the compression key 40. As noted above, once the end wall contact surfaces are defined, the forces $F_1$ and $F_4$, and thus the resultant moments about the center of gravity of the shear key, are determinable. The raised moment control pads are positioned in regard to the center of gravity of the shear key so as to establish oppositely acting moments, which because of their location, substantially offset the moments created by forces $F_1$ and $F_4$.

From the free body diagram, it can be seen that the resultant forces $F_2$ and $F_3$ acting on the moment control pads are substantially equal to forces $F_1$ and $F_4$ respectively. The contact surface area of the upper raised pad 67 is formed so that resultant force $F_2$ acts about the center of gravity of the shear key at a predetermined distance $d_2$ whereby the moment $(F_2 \times d_2)$ is substantially equal to the moment $(F_4 \times d_4)$. By the same token, the second radially aligned raised pad 68 is positioned so that the moment $(F_3 \times d_3)$ is substantially equal to the moment $(F_1 \times d_1)$. Accordingly, the moments acting in a clockwise direction about the center of gravity of the shear key are substantially equal to the moments acting in a counterclockwise direction.

By offsetting the bending moments acting on a closure wall retaining member in the manner herein described, the retaining member is loaded in compression against the casing. As a result, the deflection of the retaining member is considerably reduced and its load carrying capability greatly increased. The compressive forces are resolved into a radially acting force $F_2$, which is exerted against the bottom wall of the internal groove 28 of the casing 11, and an axially acting force $F_3$, which is translated through the compression key to the outside wall 30 of the groove $(F_3 = F_4 = F_5)$.

While the invention has been described with reference to the structure herein disclosed, it is not confined to the details as set forth and this application is intended to cover any modifications or changes as may come within the scope of the following claims.

What is claimed is:

1. Apparatus for supporting an end wall closure structure within an opening formed in the casing of a pressure vessel including a shear key seated within a groove formed in the interior wall of the opening provided within the casing with a portion of the shear key extending inwardly beyond the interior wall of the casing and being received with a complementary shoulder formed within the outer face of the end wall closure structure, and a pair of raised moment control pads carried upon the shear key and being arranged to act against one radial side face and the bottom wall of said groove in the casing, the control pads being located in regard to the center of gravity of the shear key so that the reactive bending moments translated by the end wall to said key are offset by the bending moments translated by the casing to said shear key whereby the sum of the moments acting about the key are substantially negated.

2. The apparatus of claim 1 wherein a compression key is interposed between one of the moment control pads and said one radial side wall of the groove to facilitate the assembly of the shear key within said casing.

3. The apparatus of claim 1 wherein said shear key and said compression key are formed in segments to facilitate their insertion into said groove.

4. The apparatus of claim 2 having further means to hold said shear key and said compression key in face-to-face alignment.

* * * * *